US005514482A

United States Patent [19]

Strangman

[11] Patent Number: 5,514,482

[45] Date of Patent: May 7, 1996

[54] THERMAL BARRIER COATING SYSTEM FOR SUPERALLOY COMPONENTS

[75] Inventor: Thomas E. Strangman, Phoenix, Ariz.

[73] Assignee: AlliedSignal Inc., Morris Township, N.J.

[21] Appl. No.: 603,811

[22] Filed: Apr. 25, 1984

[51] Int. Cl.[6] ..... B05D 3/02; B05D 3/06; B21D 39/00

[52] U.S. Cl. ..... 428/623; 428/610; 427/383.7; 427/554; 427/566

[58] Field of Search ..... 427/35, 53, 383.9, 427/383.7, 554, 566; 428/610, 623

[56] References Cited

U.S. PATENT DOCUMENTS

| | | | |
|---|---|---|---|
| 3,811,959 | 5/1971 | Weinstein et al. | 148/258 |
| 4,005,989 | 2/1977 | Preston | 428/651 |
| 4,122,240 | 10/1978 | Banas et al. | 427/53.1 X |
| 4,321,311 | 3/1982 | Strangman | 428/623 |
| 4,399,199 | 8/1983 | McGill et al. | 428/633 |
| 4,447,503 | 5/1984 | Dardi et al. | 428/656 X |
| 5,238,752 | 8/1993 | Duderstadt et al. | 428/623 |

FOREIGN PATENT DOCUMENTS

| | | |
|---|---|---|
| 1351302 | 12/1963 | France . |
| 2110202 | 6/1972 | France . |
| 2185696 | 1/1974 | France . |
| 59-047382 | 3/1984 | Japan . |
| 1077735 | 8/1967 | United Kingdom . |
| 1384883 | 2/1975 | United Kingdom . |
| 81/01982 | 7/1981 | WIPO . |

*Primary Examiner*—Richard D. Lovering
*Attorney, Agent, or Firm*—Jerry J. Holden; James W. McFarland

[57] ABSTRACT

An improvement in a thermal barrier coating for superalloy turbine engine components subjected to high operating temperatures, such as turbine airfoils, e.g., vanes and blades, is disclosed which eliminates the expensive MCrAlY oxidation resistant bond coating underlayer for a columnar grained ceramic thermal barrier coating. In accordance with my present invention, a relatively low cost thermal barrier coating system for superalloy turbine components is provided which utilizes a diffusion aluminide coating layer as the oxidation resistant bonding surface for the columnar grained ceramic insulating coating.

38 Claims, 1 Drawing Sheet

THERMAL BARRIER COATING SYSTEM FOR SUPERALLOY COMPONENTS

BACKGROUND OF THE INVENTION

Gas turbine engine fuel efficiency typically improves as turbine gas temperatures increase. Consequently, air-cooled superalloy airfoils have been developed to enhance engine performance. Further improvements in turbine performance and component durability can be obtained by the use of protective thermal barrier coatings which insulate the component and inhibit oxidation and hot corrosion (accelerated oxidation by fuel and air impurities such as sulfur and salt) of the superalloy.

A particular type of ceramic coating which is adherent to the metallic component but yet resistant to spalling during thermal cycling, is known as a columnar grained ceramic thermal barrier coating. The ceramic coating layer has a columnar grained microstructure and is bonded to the metal structure. Porosity between the individual columns permits the columnar grained coating to expand and contract without developing stresses sufficient to induce spalling. In accordance with present practice, the metallic article to be protected with the thermal barrier ceramic coating must first be coated with an adherent MCrAlY (M=Ni, Co, Fe) bond coating under layer which is compositionally tailored to grow an adherent, predominately aluminum oxide scale, which inhibits oxidation of the superalloy and provides a satisfactory bonding surface for the ceramic coating layer. The cost of the MCrAlY underlayer, which is normally applied by vapor deposition or other conventional coating techniques, adds substantially to the total cost of the thermal barrier coating system.

DISCUSSION OF THE PRIOR ART

My U.S. Pat. Nos. 4,321,311; 4,401,697 and 4,405,659 and those of Ulion and Ruckle, 4,321,310 and 4,405,660 disclose a thermal barrier coating system for a superalloy, formed by first applying a 1 to 10 mil thick MCrAlY vapor deposition coating on the superalloy substrate followed by the formation of a thin, thermally grown aluminum oxide (alumina) layer to which the columnar grain ceramic thermal barrier coating, e.g. zirconia stabilized with yttria oxide, is applied.

When using thermal barrier coatings of the type described in my U.S. Pat. No. 4,321,311, it is common practice to also coat internal air-cooling passages with a diffusion aluminide coating to inhibit oxidation at those locations. During application of the aluminide coating to internal surfaces, external component surfaces will also be coated with a diffusion aluminide unless they are masked. U.S. Pat. No. 4,005,989 teaches that an aluminide coating layer under an MCrAlY coating will increase coating durability. Consequently, my U.S. Pat. No. 4,321,311 also teaches that an MCrAlY coating over a diffusion aluminide coating will provide an acceptable surface for subsequent application of a columnar grained ceramic thermal barrier coating layer.

Reissue U.S. Pat. No. 31,339 discloses the application of a MCrAlY bond coat to the superalloy substrate, by plasma spraying, followed by application of an aluminide coating on the MCrAlY bond coating, followed by hot isostatic pressure treatment of the assemblage.

None of the above references, however, suggest that a columnar grained ceramic thermal barrier coating will perform satisfactorily if applied directly to a diffusion aluminide coating formed on the superalloy substrate.

DISCLOSURE OF THE INVENTION

In many instances, lower cost diffusion aluminide coatings are sufficient to provide required oxidation resistance to both internal and external surfaces of turbine airfoils. However, an insulative ceramic layer on the external airfoil surfaces will further improve component durability by reducing both metal temperatures and the magnitude of thermal strains in the metal. Alternatively, the benefit of a ceramic layer can be utilized to increase turbine performance by permitting cooling air requirements to be reduced or by allowing turbine inlet temperatures to be increased.

In my prior U.S. Pat. No. 4,321,311, I utilized an MCrAlY bond coating to both inhibit oxidation and provide a bonding surface for the ceramic layer. In most gas turbine applications, however, it is not necessary to use an expensive MCrAlY coating to inhibit oxidation. It was subsequently discovered that for several superalloys it is not necessary to utilize an MCrAlY coating layer to develop an adherent alumina scale, which is necessary for ceramic layer adhesion. In several instances, it was discovered that a lower cost diffusion aluminide coating could thermally grow an alumina scale with sufficient adhesion for a viable bonding surface. Consequently, the cost of a thermal barrier coating can be significantly reduced in those instances where the diffusion aluminide coating provides an adequate bonding surface.

Air-cooled turbine blades are typically aluminized on internal surfaces to inhibit oxidation. However, since the diffusion aluminizing process is multi-directional, it can provide an aluminide layer on the entire blade, i.e. both interior and exterior, and in many instances this diffusion aluminide coating provides adequate oxidation resistance. In accordance with my present invention, it has been found that the ceramic thermal barrier coating may be applied directly to the diffusion aluminide coating, thus eliminating the expensive MCrAlY coating layer. The ceramic thermal barrier coating, in contrast to the aluminide application process, is applied by a line-of-sight process which coats only the desired portion of the component, i.e. the exterior portion of the airfoil.

Although coatings of this invention have been thusfar developed for their thermal barrier benefits, other uses can also be anticipated. In particular, thin ceramic coatings (e.g. stabilized zirconia, zircon) applied on top of diffusion aluminides have potential value in inhibiting hot corrosion attack of the component by fuel and air impurities (e.g., sulfur and salt). Subsequent densification of the outer surface of the columnar ceramic layer (e.g. by laser glazing) would increase the surface density and hardness and thus provide a barrier to inhibit both hot corrosion and erosion from ingested sand or combustor produced carbon particles.

BRIEF DESCRIPTION OF THE DRAWINGS

My invention will be described hereinafter with reference to the accompanying drawings, wherein.

DESCRIPTION OF THE PREFERRED EMBODIMENT

Figure 1:
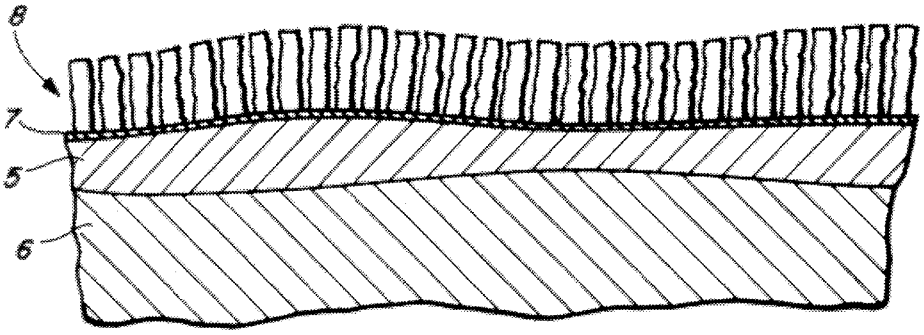
FIG. 1 is a cross sectional view of a magnified schematic drawing of the coating of the invention.

My present invention involves a thermal barrier coated turbine component which include two inter-related layers on the superalloy substrate. The base metal or substrate of my present invention may be nickel, cobalt or iron base high temperature alloys used for turbine airfoil applications, i.e. blades or vanes. My present invention is particularly applicable to hafnium and/or zirconium containing superalloys such as MAR-M247, IN-100 and MAR-M 509, the compositions of which are shown in Table I.

TABLE I

| ALLOY | Mo | W | Ta | Al | Ti | Cr | Co | Hf | V | Zr | C | B | Ni |
|---|---|---|---|---|---|---|---|---|---|---|---|---|---|
| Mar-M247 | .65 | 10 | 3.3 | 5.5 | 1.05 | 8.4 | 10 | 1.4 | — | .055 | .15 | .15 | bal. |
| IN-100 | 3.0 | — | — | 5.5 | 4.7 | 9.5 | 15.0 | | 1.0 | .06 | .17 | .015 | bal. |
| Mar-M509 | — | 7.0 | 3.5 | — | 0.25 | 23.4 | Bal. | — | — | .5 | .6 | — | 10.0 |

Diffusion aluminide coatings have adequate oxide scale adhesion on hafnium and/or zirconium containing superalloys. Oxide scale adhesion may be promoted for coatings of my present invention on superalloys which do not contain hafnium, or a similar element, such as La, by the use of complex diffusion aluminides; i.e. aluminide coatings containing additions of elements which promote oxide scale adhesion, such as Pt, Rh, Si, and Hf.

The diffusion aluminide coating used in connection with my present invention can be applied by standard commercially available aluminide processes whereby aluminum is reacted at the substrate surface to form an aluminum intermetallic compound which provides a reservoir for the alumina scale oxidation resistant layer. Thus the aluminide coating is predominately composed of aluminum intermetallic [e.g. NiAl, CoAl, FeAl and (Ni, Co, Fe)Al phases] formed by reacting aluminum vapor species, aluminum rich alloy powder or surface layer with the substrate elements in the outer layer of the superalloy component. This layer is typically well bonded to the substrate. Aluminiding may be accomplished by one of several conventional prior art techniques, such as, the pack cementation process, spraying, chemical vapor deposition, electrophoresis, sputtering, and slurry sintering with an aluminum rich vapor and appropriate diffusion heat treatments. The aluminiding layer may be applied at a temperature from room temperature to 2100° F. depending upon the particular aluminiding process employed. The aluminiding layer for my present invention, should be applied to a thickness of about 1 to 5 mils.

Other beneficial elements can also be incorporated into diffusion aluminide coatings by a variety of processes. Beneficial elements include Pt, Si, Hf and oxide particles, such as alumina, yttria, hafnia, for enhancement of alumina scale adhesion, Cr and Mn for hot corrosion resistance, Rh, Ta and Cb for diffusional stability and/or oxidation resistance and Ni, Co for increasing ductility or incipient melting limits. These elements can be added to the surface of the component prior to aluminizing by a wide range of processes including electroplating, pack cementation, chemical vapor deposition, powder metal layer deposition, thermal spray or physical vapor deposition processes. Some methods of coating, such as slurry fusion, permit some or all of the benefical coating elements, including the aluminum, to be added concurrently. Other processes, such as chemical vapor deposition and pack cementation, can be modified to concurrently apply elements such as Si and Cr with the aluminum. In addition, it is obvious to those skilled in the art that diffusion aluminide coatings will contain all elements present within the surface layer of the substrate.

In the specific ease of platinum modified diffusion aluminide coating layers, the coating phases adjacent to the alumina scale will be platinum aluminide and/or nickel-platinum aluminide phases (on a Ni-base superalloy).

The diffusion aluminide coating in accordance with my present invention provides aluminum rich intermetallic phase(s) at the surface of the substrate which serve as an aluminum reservoir for subsequent alumina scale growth. An alumina scale or layer is utilized in my present invention between the diffusion aluminide coating and the ceramic layer to provide both oxidation resistance and a bonding surface for the ceramic layer. The alumina layer may be formed before the ceramic thermal barrier coating is applied or formed during application of the thermal barrier columnar grained coating. The alumina scale can also be grown subsequent to the application of the ceramic coating by heating the coated article in an oxygen containing atmosphere at a temperature consistent with the temperature capability of the superalloy, or by exposure to the turbine environment. The sub-micron thick alumina scale will thicken on the aluminide surface by heating the material to normal turbine exposure conditions. The thickness of the alumina scale is preferably sub-micron (up to about one micron).

The thermal barrier coating which is applied as the final coating layer in my present invention, is a columnar grained ceramic coating which is tightly bonded to the underlying alumina film on the aluminide coating, which is applied to the substrate. The columnar grains are oriented substantially perpendicular to the surface of the substrate with interstices between the individual columns extending from the surface of the thermal barrier coating down to or near (within a few microns) the alumina film on the aluminide coating. The columnar grained structure of this type of thermal barrier coating minimizes any stresses associated with the difference in the co-efficients of thermal expansion between the substrate and the thermal barrier coating, which would otherwise cause a failure in a dense or continuous ceramic thermal barrier coating. When heated or cooled, the substrate expands (or contracts) at a greater rate than the ceramic thermal barrier coating. Gaps between the ceramic columnar grains permit the grains to expand and contract without producing sufficient stress to induce spalling or cracking of the thermal barrier coating. This limits the stress at the interface between the substrate and the thermal barrier coating, thus preventing fractures in the ceramic coating.

The columnar grain thermal barrier coating used in my present invention may be any of the conventional ceramic compositions used for this purpose. Currently the strain-tolerant zirconia coatings are believed to be particularly effective as thermal barrier coatings; however, my present invention is equally applicable to other ceramic thermal barrier coatings. A preferred ceramic coating is the yttria stabilized zirconia coating. These zirconia ceramic layers have a thermal conductivity that is about 1 and one-half orders of magnitude lower than that of the typical superalloy substrate such as MAR-M247. The zirconia may be stabilized with CaO, MgO, $CeO_2$ as well as $Y_2O_3$. Other ceramics which are believed to be useful as the columnar type coating materials within the scope of my present invention are alumina, ceria, hafnia (yttria-stabilized), mullite, zirconium silicate and certain borides and nitrides, e.g. titanium diboride, and silicon nitride.

The columnar ceramic material may have some degree of solid solubility with the alumina scale. Also the particular ceramic material selected for use as the columnar grain thermal barrier coating should be stable in the high temperature environment of a gas turbine.

The ceramic layer may be applied by a prior art technique which provides an open columnar microstructure, preferably the electron beam evaporation-physical vapor deposition process. The thickness of the ceramic layer may vary from 1 to 1000 μm but is typically in the 50 to 300 μm range for typical thermal barrier applications.

The electron beam evaporation-physical vapor deposition process for applying the thermal barrier coating is a modification of the standard high-rate vapor deposition process for metallic coatings. Power to evaporate the ceramic coating material is provided by a high-energy electron beam gun. The zirconia vapor produced by evaporation of the zirconia target material, condenses onto the turbine airfoil component to form the thermal barrier coating. Zirconia coating deposition rates are typically in the range of about 0.01 to 1.0 mils per minute. The parts to be coated are preheated in a load lock by either radiant or electron beam heat sources and/or heated in the coating chamber prior to exposure to the ceramic vapor. During coating, the component temperature is typically maintained in the 1500° to 2100° F. range. Since zirconia becomes somewhat oxygen deficient due to partial dissociation during evaporation in a vacuum, oxygen is also bled into the yttria-stablized zirconia vapor cloud to minimize any deviation from stoichiometry during coating.

By my present invention the ceramic thermal barrier coating is applied directly to the diffusion aluminide metallic coating.

In accordance with my present invention, ceramic coatings on turbine airfoils accommodate large strains without developing stresses of a sufficient magnitude to cause spalling. This strain tolerance is achieved by the above-mentioned microstructural discontinuities within the columnar grained ceramic insulative layer, which permits the ceramic-layer strain to be accommodated with minimal stress on the ceramic to metal interface region.

DETAILED DESCRIPTION OF THE DRAWINGS

FIG. 1 is a schematic cross-sectional line drawing showing a coating in accordance with my present invention, wherein the aluminide coating 5 is applied to the superalloy substrate 6 and an adherent alumina scale layer 7 is formed on the aluminide coating 5. The columnar grain ceramic layer 8 overlays the alumina layer 7.

Figure 2:
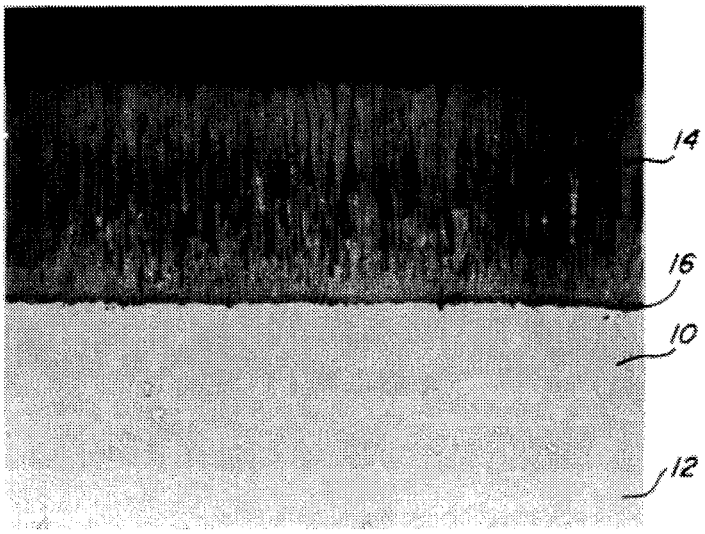
FIG. 2 is a photomicrograph of a superalloy substrate coated in accordance with my invention.

FIG. 2 is a photomicrograph of a zirconia insulative layer deposited on superalloy substrate in accordance with my present invention. In this thermal barrier coating system, a diffusion aluminide oxidation resistant layer 10 was deposited directly on the Mar-M247 superalloy substrate 12 and a yttria-stabilized zirconia thermal barrier coating 14 was applied to the substrate. As may be seen from FIG. 2, a thin alumina film 16 is formed between the diffusion aluminide coating and the zirconia coating. The Hf content of the superalloy substrate enhances the adhesion of the alumina layer formed on the aluminide and to which the zirconia layer is adherred.

Figure 3:
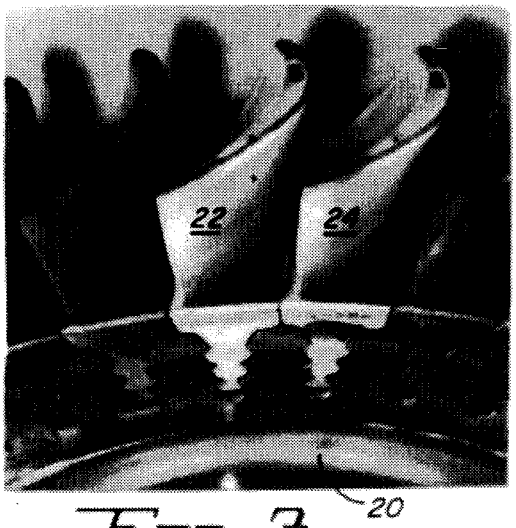
FIG. 3 is a photograph showing turbine blades coated in accordance with this invention.

FIG. 3 is a photograph of a turbo-prop engine turbine showing high pressure turbine blades mounted in disc 20. Blades 22 and 24 shown as whitish, have been coated in accordance with my present invention with yttria-stabilized zirconia. The blades are shown subsequent to 240 hours service in a TPE 331-10 Turbo-prop Engine.

EXAMPLE 1

TPE 331-10 turboprop engine high pressure turbine blades of IN-100 alloy were coated with a diffusion aluminide plus EB-PVD yttria-stabilized zirconia system. The commercially available Chromalloy RT-21 pack cementation diffusion nickel aluminide coating was applied to a nominal thickness of 2 mils. Following application of the diffusion aluminide coating layer, the yttria (approximately 20%) stabilized zirconia coating layer was applied to the surface of the aluminide coated blades, by the commercial Airco Temescal EB-PVD process. The thickness of the zirconia coating was also 2 mils. The ceramic coating was applied by evaporating a yttria-stabilized zirconia ingot with power provided by a high-energy electron beam gun focused magnetically onto the zirconia target, which was the vapor source. The cloud of zirconia vapor is produced by the evaporation of the zirconia target material and vapor from this cloud condensed onto the blades at a rate of about 0.2 mil/min. to form the ceramic coating layer. Substrate temperature during coating was about 1800° F.

The coated blades were then installed in the TPE 331-10 engine and successfully tested for 240 hours of engine operating time. FIG. 3 shows the blades after the test, confirming that the blades were in good condition after the 240 hour engine test.

EXAMPLE 2

A burner rig specimen of MAR-M247 was diffusion aluminide coated with the Chromalloy RT-21 pack cementation process to a nominal thickness of 2 mils and then a 5 mil thick $Y_2O_3$ stabilized zirconia coating applied by a commercial Airco Temescal EB-PVD process. A second burner rig specimen was diffusion aluminide coated with Chromalloy's RT 22 process which provides a Pt-modified aluminide coating, and the same columnar grained ceramic coating applied. The burner rig specimens were subjected to a test cycle comprising 4 minutes at 2100° F. followed by 2 minutes of forced air cooling. The specimens withstood 400 cycles over a 40 hour period.

EXAMPLE 3

ATF3-6 turbofan engine high pressure turbine paired-vanes of the MAR-M 509 alloy were coated with a diffusion aluminide plus EB-PVD yttria-stabilized zirconia system in accordance with this invention. The commercially available chromalloy RT-19 pack cementation diffusion cobalt aluminide coating was applied to a nominal thickness of 2 mils. Following application of the diffusion aluminide coating layer, the yttria-stabilized (approximately 20%) zirconia coating layer was applied to the surface of the aluminide coated vanes by a commercially available Airco Temescal EB-PVD process. The nominal thickness of the zirconia coating was 3 to 8 mils.

These thermal barrier coated paired vanes were concurrently evaluated with paired vanes coated with only the diffusion aluminide for 217 hours in an ATF 3-6 test engine. Post-test examination indicated that the durability of the thermal barrier coated vanes was increased relative to the vanes without the insulative zirconia coating layer.

While my present invention has been described herein with a certain degree of particularity in reference to certain specific coating and alloy compositions which were formulated and tested, it is to be understood that the scope of my invention is not limited thereto, but should be afforded the full scope of the appended claims.

I claim as my invention:

1. A superalloy article of manufacture of the type having a ceramic thermal barrier coating on at least a portion of its surface, comprising:

(a) a superalloy substrate;

(b) an adherent, diffusion-aluminide coating applied to said portion of the substrate and adapted to be a reservoir of aluminum for the subsequent in situ formation of an alumina protective scale on said aluminide coated substrate; and (c) a columnar grained ceramic coating bonded directly to said aluminide coating and adapted to allow in situ oxidation of said aluminide to alumina.

2. The article of claim 1 wherein said diffusion aluminide coating is from 0.5 to 5 mils thick.

3. The article of claim 1 wherein the ceramic coating is from 0.5 to 50 mils thick.

4. The article of claim 1 wherein said diffusion aluminide coating is modified by at least one of the elements selected from the group consisting of Pt, Rh, Si, Hf, Cr, Mn, Ta, and Cb.

5. The article of claim 1 wherein said diffusion aluminide coating is modified by dispersed particles selected from the group consisting of alumina, yttria and hafnia.

6. The article of claim 1 having an MCrAlY overlay coating applied to the superalloy substrate under the diffusion aluminide coating.

7. The article of claim 1 wherein an adherent alumina layer has formed in situ due to oxygen transfer between said aluminide coating and said ceramic coating.

8. The article of claim 1 wherein said ceramic coating is yttria-stabilized zirconia.

9. The article of claim 1 wherein said ceramic coating is zirconia stabilized with at least one oxide selected from the group consisting of CaO, MgO, and $CeO_2$.

10. The article of claim 1 wherein said ceramic coating is selected from the group consisting of alumina, ceria, yttria-stabilized hafnia, zirconium silicate and mullite.

11. The article of claim 1 wherein said ceramic coating is selected from the group consisting of borides and nitrides.

12. The article of claim 1 wherein up to 0.1 mil of the ceramic adjacent to the alumina scale has a denser microstructure, which may vary from equiaxed grains to columnar grains with the balance of the ceramic coating having a fully columnar grained microstructure.

13. A superalloy article having a ceramic thermal barrier coating, comprising:

(a) a superalloy substrate;

(b) an adherent, diffusion-aluminide coating applied to said substrate and forming a reservoir of aluminum for the formation of an alumina protective scale on said aluminide coated substrate;

(c) a columnar grained ceramic coating bonded to said aluminide-alumina coating; and (d) wherein the exterior of the ceramic coating is densified by glazing.

14. The method for producing a superalloy article having an adherent ceramic thermal barrier coating thereon, comprising the steps of:

(a) providing a superalloy substrate with a clean surface;

(b) applying a diffusion aluminide layer to at least a portion of the clean superalloy substrate surface; and (c) applying a columnar grained ceramic coating directly to the diffusion aluminide layer on said superalloy substrate.

15. The method of claim 14 including the further step of forming, in situ, an adherent alumina layer on said diffusion aluminide coating by oxidation thereof.

16. The method of claim 15 wherein said alumina layer is formed on said aluminide coating by heat treating the ceramic coated article in an oxygen containing atmosphere at a temperature of between 1600° and 2100° F.

17. The method of claim 14 including the step of modifying the substrate surface by applying a material selected from the group consisting of Pt, Rh, Si, Hf, Cr, Ta, Cb, alumina, yttria, hafnia, and a MCrAlY surface layer, prior to aluminiding.

18. The method of claim 14 wherein said columnar grained ceramic coating is applied by vapor deposition.

19. The method for manufacturing a superalloy article having an adherent ceramic thermal barrier coating thereon, comprising the steps of:

(a) providing a superalloy substrate with a clean surface;

(b) applying a diffusion aluminide layer to at least a portion of the clean superalloy surface;

(c) applying a columnar grained ceramic coating to the diffusion aluminide layer on said superalloy substrate; and (d) densifying the exterior of the ceramic coating by electron beam glazing.

20. The method for manufacturing a superalloy article having an adherent ceramic thermal barrier coating thereon, comprising the steps of:

(a) providing a superalloy substrate with a clean surface;

(b) applying a diffusion aluminide layer to at least a portion of the clean superalloy surface;

(c) applying a columnar grained ceramic coating to the diffusion the clean superalloy surface;

(d) densifying the exterior of the ceramic coating by laser glazing.

21. A superalloy article having a thermal barrier coating system thereon, comprising:

a substrate made of a material selected from the group consisting of a nickel-based superalloy and a cobalt-based superalloy; and a thermal barrier coating system on the substrate, the thermal barrier coating system including an intermetallic bond coat overlying the substrate, the bond coat being selected from the group consisting of a nickel aluminide and a platinum aluminide intermetallic compound, a thermally grown aluminum oxide layer overlying the intermetallic bond coat, and a columnar grained ceramic topcoat overlying the aluminum oxide layer.

22. The article of claim 21, wherein the intermetallic bond coat is from about 0.001 to about 0.005 inches thick.

23. The article of claim 22, wherein the layer of aluminum oxide is less than about 1 micron thick.

24. The article of claim 21, wherein the ceramic topcoat is from about 1 to 1000 microns thick.

25. The article of claim 21, wherein the ceramic topcoat includes zirconium oxide and yttrium oxide.

26. The article of claim 21, wherein the ceramic topcoat is zirconium oxide plus from 0 to about 20 percent by weight yttrium oxide.

27. The article of claim 21, wherein the article is a gas turbine blade.

28. The article of claim 21, wherein the intermetallic coating includes at least one alloying element that does not alter the intermetallic character of the coating.

29. A superalloy article having a thermal barrier coating system thereon, comprising:

a substrate made of superalloy selected from the group consisting of a nickel-based superalloy and a cobalt-based superalloy; and a thermal barrier coating system on the substrate, the thermal barrier coating system including an aluminide intermetallic bond coat upon the substrate, the bond coat being selected from the group consisting of a nickel aluminide and a platinum aluminide, the bond coat having a thickness of from about 0.001 to about 0.005 inches thick, a layer of a thermally grown aluminum oxide upon the intermetallic bond coat, the layer of aluminum oxide being less than about 1 micron thick, and a ceramic topcoat upon the layer of aluminum oxide, the ceramic topcoat having a composition of zirconium oxide plus from 0 to about 20 weight percent yttrium oxide and a columnar grain structure wherein the columnar axis is substantially perpendicular to the surface of the intermetallic bond coat.

30. The article of claim 29, wherein the nickel aluminide is NiAl.

31. A process for preparing a superalloy article having a thermal barrier coating system thereon, comprising:

furnishing a substrate made of a nickel-based superalloy;

depositing upon the surface of the substrate an aluminide intermetallic coating that has a substantially smooth upper surface, said aluminide intermetallic coating being selected from the group consisting of a nickel aluminide and a platinum aluminide intermetallic compound;

thermally oxidizing the upper surface of the intermetallic coating to form an aluminum oxide layer; and depositing upon the surface of the aluminum oxide layer a columnar grained ceramic topcoat by physical vapor deposition.

32. The process of claim 31, wherein the temperature of the substrate during the step of depositing the intermetallic coating is less than about 2100° F.

33. The process of claim 31, wherein the temperature of the substrate during the step of depositing the ceramic topcoat is from about 1500° F. to about 2100° F.

34. The process of claim 31, wherein the aluminide is platinum rhodium aluminide.

35. A thermal barrier coating system for metallic substrates, comprising:

an intermetallic bond coat overlying a substrate selected from the group consisting of nickel-based, cobalt-based and iron-based superalloys, the bond coat being selected from the group consisting of a nickel aluminide and a platinum aluminide intermetallic compound, and a columnar grained ceramic topcoat overlying the intermetallic coating.

36. The coating system of claim 35, wherein the bond coat is oxidized to form an aluminum oxide layer between the bond coat and the topcoat.

37. A superalloy article having a thermal barrier coating system thereon, comprising:

a substrate made of a material selected from the group consisting of a nickel-based superalloy and a cobalt-based superalloy; and a thermal barrier coating system on the substrate, the thermal barrier coating system including an intermetallic bond coat overlying the substrate, the bond coat being selected from the group consisting of a nickel aluminide and a platinum aluminide intermetallic compound, a thermally grown aluminum oxide layer overlying the intermetallic bond coat, and a ceramic topcoat overlying the aluminum oxide layer.

38. A thermal barrier coating system for metallic substrates, comprising:

an intermetallic bond coat overlying a substrate selected from the group consisting of nickel-based, cobalt-based and iron-based superalloys, the bond coat being selected from the group consisting of a nickel aluminide and a platinum aluminide intermetallic compound, and a ceramic topcoat overlying the intermetallic coating.

* * * * *

UNITED STATES PATENT AND TRADEMARK OFFICE

CERTIFICATE OF CORRECTION

PATENT NO. : 5,514,482

DATED : May 7, 1996

INVENTOR(S) : Thomas Strangman

It is certified that error appears in the above-identified patent and that said Letters Patent is hereby corrected as shown below:

Col. 8, line 38, after "diffusion" delete "the clean" insert --aluminide layer on said--; delete "surface" insert --substrate--; insert --and-- after the semicolon (;).

Signed and Sealed this

Thirteenth Day of August, 1996

*Attest:*

BRUCE LEHMAN

*Attesting Officer*

*Commissioner of Patents and Trademarks*